United States Patent [19]

Kinney et al.

[11] Patent Number: 4,945,328

[45] Date of Patent: Jul. 31, 1990

[54] ELECTRICAL CONTACTOR

[75] Inventors: John W. Kinney, Aurora; Anthony P. Rubasch, St. Charles; Thomas W. Degenhart, Batavia, all of Ill.

[73] Assignee: Furnas Electric Company, Batavia, Ill.

[21] Appl. No.: 265,005

[22] Filed: Oct. 31, 1988

[51] Int. Cl.[5] ..... H01H 9/02

[52] U.S. Cl. ..... 335/202; 335/131

[58] Field of Search ..... 335/131–133, 335/202; 200/193, 195, 205, 208; 336/192

[56] References Cited

U.S. PATENT DOCUMENTS

| | | | |
|---|---|---|---|
| 3,189,772 | 6/1965 | Wingler et al. | 336/192 |
| 3,469,215 | 9/1969 | Brovedan . | |
| 4,506,243 | 3/1985 | Okado et al. . | |
| 4,547,759 | 10/1985 | Mueller | 336/192 |
| 4,724,410 | 2/1988 | Degenhart . | |
| 4,760,364 | 7/1988 | Ostby | 335/202 |

*Primary Examiner*—Leo P. Picard
*Assistant Examiner*—Lincoln Donovan
*Attorney, Agent, or Firm*—Wood, Phillips, Mason, Recktenwald & VanSanten

[57] ABSTRACT

The manufacture of an electrical contactor is simplified by a construction including a base 22, a contactor assembly 20 including at least one movable contact 32 mounted on the base, a magnetic core 26 mounted on the base 22 in proximity to the contactor assembly 20, and a bobbin 28 mounted on the magnetic core 26 and having spaced flanges 112, 114 defining a peripheral winding receiving recess 118 wherein the flange 112 has terminal receiving recesses 122 in an edge 120 thereof. Metallic pins 132 have one end captured in the edge 120 and receive the ends 164 of an electrical winding on the bobbin 126 in wrapped around fashion. A plurality of metallic terminal pieces 128 are provided, one for each of the recesses 122 and include a finger 156 crimped about the corresponding pin 132 and the winding end 164 wrapped thereabout.

11 Claims, 4 Drawing Sheets

ELECTRICAL CONTACTOR

FIELD OF THE INVENTION

This invention relates to an electrical contactor, and more particularly, to an improved bobbin and terminal construction in a contactor as well as an improved shell and bobbin construction.

BACKGROUND OF THE INVENTION

Electrical contactors of various sorts have been utilized in an untold number of applications for many years. As one might expect, therefore, the art of electrical contactor fabrication is quite well developed and highly competitive. Generally, the competitive offerings are comparable in terms of reliability and long life with the result that the principal competitive factor is price. Consequently, it is highly desirable to provide a contactor that is economically manufactured so as to be price competitive and which retains or improves upon the reliability of prior art constructions.

The present invention is directed to attaining the above results.

SUMMARY OF THE INVENTION

It is the principal object of the invention to provide a new and improved electrical contactor. More specifically, it is an object of the invention to provide a contactor construction that can be (a) economically fabricated to provide a contactor that is highly price competitive, and (b) which is extremely reliable.

According to one facet of the invention, the contactor includes a base and a contactor assembly having at least one movable contact mounted on the base. A magnetic core is mounted on the base in proximity to the contactor assembly. A bobbin is mounted on the magnetic core and has spaced flanges defining a peripheral winding receiving recess. At least one of the flanges has terminal receiving recesses in an edge thereof and metallic pins, one for each terminal receiving recess, are provided. Each metallic pin has one end captured in the edge of the bobbin adjacent the corresponding terminal receiving recess and an opposite end projecting away from the corresponding terminal receiving recess. An electrical winding is located in the winding receiving recess and has ends extending therefrom which are wrapped around a corresponding one of the pins. Also provided is a plurality of metallic terminals, one for each terminal receiving recess, and each having a mounting end disposed in the corresponding recess and a finger crimped about the corresponding pin and the winding end wrapped thereabout.

As a consequence of this construction, the assembly of the terminals to the bobbin and the electrical connection of the same to the winding is considerably simplified to provide an economically manufactured contactor.

According to one aspect of the invention, one of the flanges having a terminal receiving recess therein further includes a ramp-like slot extending from the terminal receiving recess substantially to the bottom of the winding receiving recess and one of the winding ends passes through the ramp-like slot.

The invention contemplates that the bobbin be a molded part and that the pins be captured by molding the bobbin about the ends of the pins.

According to another aspect of the invention, there is a contactor that includes a base and a contactor assembly as before. A magnetic core having at least one pole is mounted on the base and a bobbin having a central opening is disposed on the magnetic core with the pole entering and extending through the central opening. The bobbin has spaced flanges defining a peripheral winding receiving recess and an electrical winding is located in the winding receiving recess and has ends extending therefrom. A plurality of metallic terminals are provided, one for each winding end and are mounted on the bobbin.

The contactor includes a shell on the base which has walls defining a coil chamber in the shape of a rectangular solid. An access opening is provided to the chamber through one of the walls and is sized to snugly receive the bobbin. Opposed walls of the shell which are adjacent the one wall have aligned openings receiving the pole of the magnetic core and the bobbin is located in the chamber with the central opening aligned with the aligned openings in the coil chamber walls and also receives the pole. According to this facet of the invention, reliability is enhanced because electrical isolation of the coil from the magnetic core is enhanced.

In a highly preferred embodiment, the flanges are generally planar and are in substantial abutment with corresponding ones of the opposed walls of the coil chamber to provide excellent electrical isolation.

The invention further contemplates that the terminals extend from the chamber through the access opening and that the structure include a closure mounted on the shell for closing the opening. In a highly preferred embodiment of the invention, there includes means that are effective upon closing the access opening by the closure for securing the terminals in their respective recesses on the bobbin.

The invention contemplates that the closure and the shell include mating tracks so that the shell may slideably receive the closure about the access opening. In a highly preferred embodiment of the invention, the closure is formed by a single closure piece.

Other objects and advantages will become apparent from the following specification taken in connection with the accompanying drawings.

DESCRIPTION OF THE PREFERRED EMBODIMENT

Figure 1:
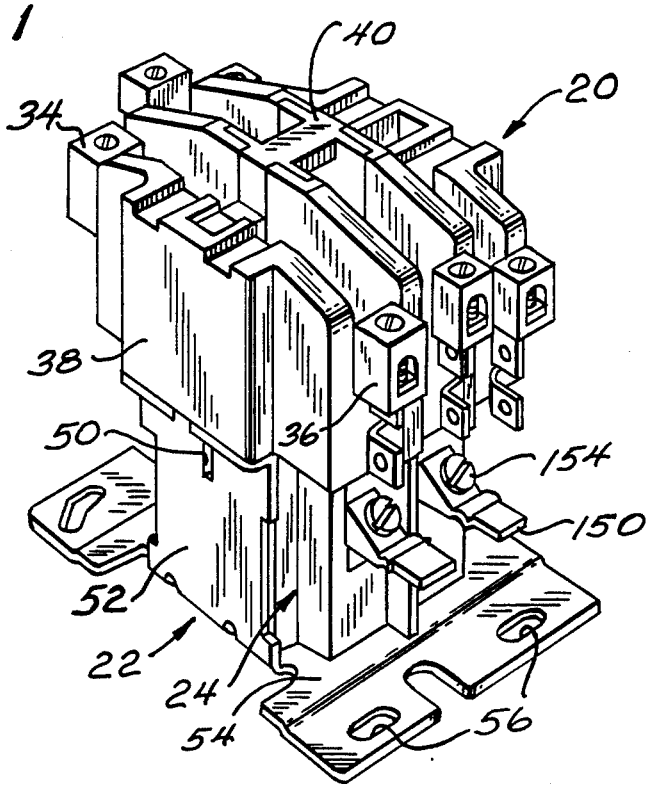
FIG. 1 is a perspective view of a contactor made according to the invention.
Figures 2, 11, 12:
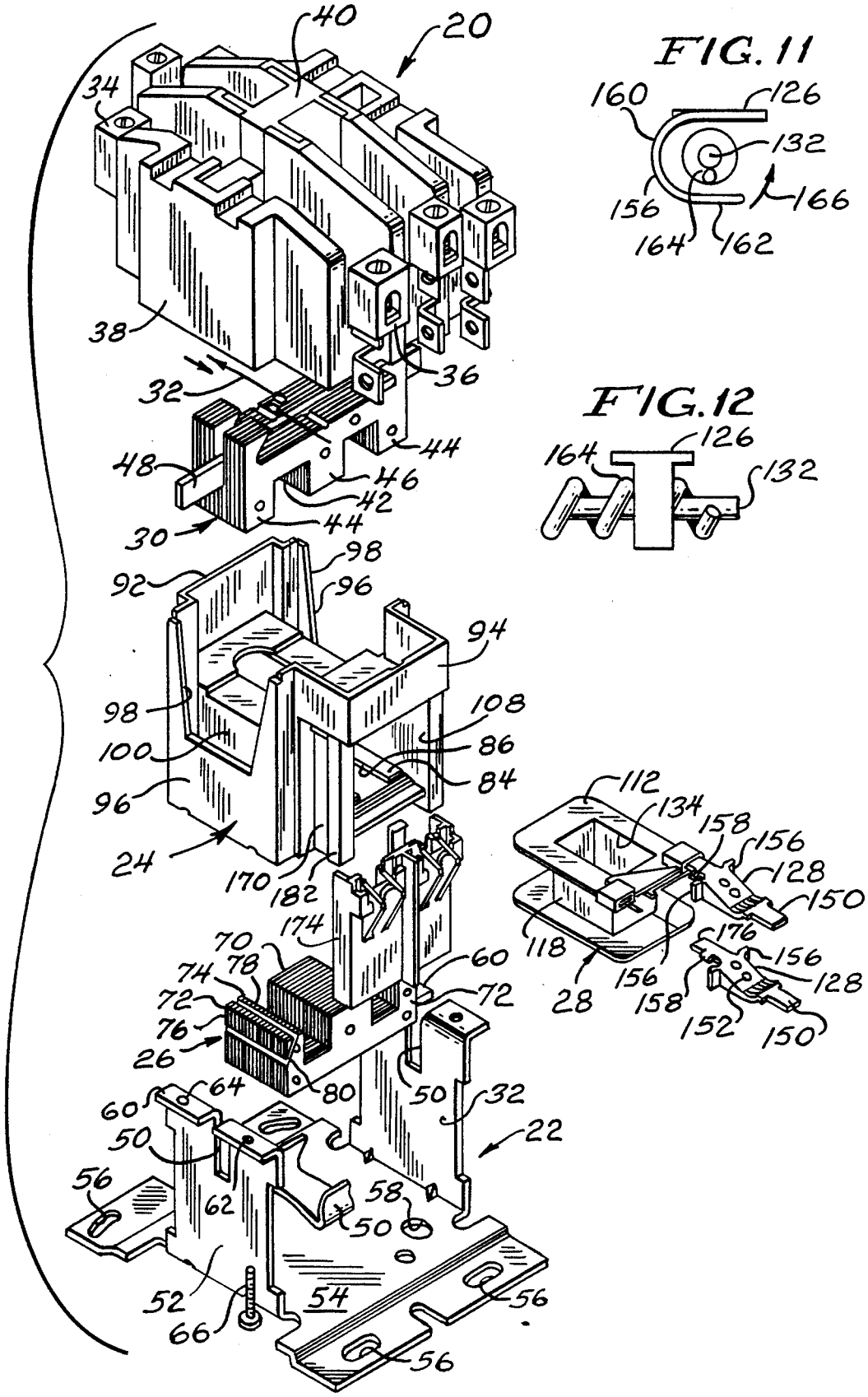
FIG. 2 is an exploded view of the contactor.
FIG. 11 is a fragmentary, enlarged end view of a terminal connection in the process of being formed.
FIG. 12 is an elevation taken from the left of FIG. 11.

An exemplary embodiment of an electrical contactor made according to the invention is illustrated in the drawings and with reference to FIGS. 1 and 2 is seen to be composed to six principal components. A first is an upper contactor assembly, generally designated 20, and a second is a generally U-shaped base, generally designated 22. A shell, generally designated 24, is located between the base 22 and the contactor assembly 20 and with the former serves to locate a magnetic core, generally designated 26, within the assembly. The core 26 is made of laminated magnetic steel as is well known.

A bobbin, winding and terminal assembly, generally designated 28, is located within the shell 24 as will be described. The general configuration is completed by a laminated magnetic steel armature, generally designated 30, which is conventionally associated with movable contacts such as shown schematically at 32 in FIG. 2 and contained within the contactor assembly 20.

The contactor assembly 20 specifically is of known type and, as mentioned previously, includes a plurality of isolated movable contacts such as the contacts 32 which are operable upon movement of the armature 30 toward the base 22, to establish an electrical circuit between opposed fixed contacts shown schematically at 34 and 36 respectively. As illustrated in FIGS. 1 and 2, the contactor is a three-pole contactor from the electrical standpoint. If desired, the same could be made in the configuration illustrated in commonly assigned U.S. Pat. No. 3,824,509, issued July 16, 1974, to McGarry, the details of which are herein incorporated by reference.

The main part of the contactor assembly 20 is a housing 38 made of an insulating plastic. Slideable within the housing 38 is an insulating plastic bar 40 which is operable to move the movable contacts 32 as mentioned previously. The bar 40 is connected by any suitable means to a dovetail slot 42 in the upper surface of the armature 30. In this way, movement of the armature 30 effects closure of the contacts 32. A biasing spring (not shown) is employed to bias the contacts 32 to an open position.

The armature 30, in addition to the dovetail slot 42, and oppositely thereof, has three magnetic poles including side poles 44 and a central pole 46. The poles 34 and 36 are directed toward the base 12. Extending from the sides of the armature 30 is guide bar 48, opposite ends of which are received in vertical slots 50 at the upper ends of parallel legs 52 of the U-shaped base 22. Thus, the armature 30 is guided for movement toward and away from the bight 54 of the U-shaped base 12.

As illustrated, the bight 54 includes fastener receiving openings such as illustrated at 56 allowing the contactor to be secured in a desired location through the use of threaded fasteners or the like. The bight 56 may also include locating holes 58 which, as will be seen, serve to properly orient the shell 24 thereon.

The legs 52 terminate in outwardly directed flanges 60 which are generally parallel to the bight 54. Each includes a fastener receiving aperture 62 and a locating hole 64. A threaded fastener 66 is passed upwardly through each aperture 62 to be threaded into an aligned bore (not shown) in the underside of the housing 38 of the contactor assembly 20. That same underside may have a small, downwardly projecting post (also not shown) receivable in a corresponding one of the locating holes 64 so as to assure proper orientation of the housing 38, and thus the contactor assembly 10, on the base 12.

The magnetic core 26 is generally E-shaped as illustrated in FIG. 2 and includes a central pole 70 that faces and is aligned with the pole 46 on the armature 30. The central pole 70 is flanked by side poles 72 facing and aligned with the poles 44. Each of the side poles 72 has an upper surface 74 and a side surface 76 which include a slot 78 which in turn receives a conventional shading ring 80 for the usual purposes.

The side poles 72 are respectively received through openings 82 (FIG. 7) in a raised bottom 84 (FIGS. 2, 6 and 7) of the shell 24. The bottom 84 also includes a central hole 86 (FIGS. 2 and 7) through which the central pole 70 of the magnetic core 26 is received.

A U-shaped spring 90 (FIG. 2) may be placed on the magnetic core 26 from the underside thereof in alignment with the central pole 70. The spring 90 is used to control the so-called "bounce" of the contacts 32 and functions by dissipating kinetic energy in the core and armature system through friction.

The shell 24 is made of an insulating plastic and includes an upstanding rear wall 92, a forward wall 94, and opposed side walls 96, the latter being provided with slots 98 to accommodate movement of the armature mounted bar 48.

The shell 24 also includes internal side walls 100 which are spaced apart to just allow the bobbin 28 to be snugly nested between them. An interior upper wall 102 extends between the interior side walls 100 in spaced but parallel relation to the bottom wall 84. The spacing between the walls 84 and 102 is of about the thickness of the bobbin 28 so that the same may be snugly nested between the two as will be described in greater detail hereinafter. The upper interior wall 102 also has a central opening 104 which is aligned with the opening 86 in the bottom wall 84 and which is adapted to receive the pole 70 of the magnetic core 26.

It can thus be appreciated that the rear and front walls 92 and 94 together with the bottom wall 84 as well as the interior walls 100 and 102 define a coil receiving chamber 106 that is in the shape of a rectangular solid. The bobbin 28, with an electrical winding thereon, may be disposed in the coil receiving chamber 106 by insertion through an access opening 108 in the front wall 94. That is to say, the access opening 108 is in a wall, the front wall 94, that is immediately adjacent to the opposed walls 84 and 102 which contain the pole receiving openings 86 and 104, respectively.

A core chamber is defined by the space below the bottom wall 84 and the spaces between the interior walls 100 and the side walls 96.

Figure 6:
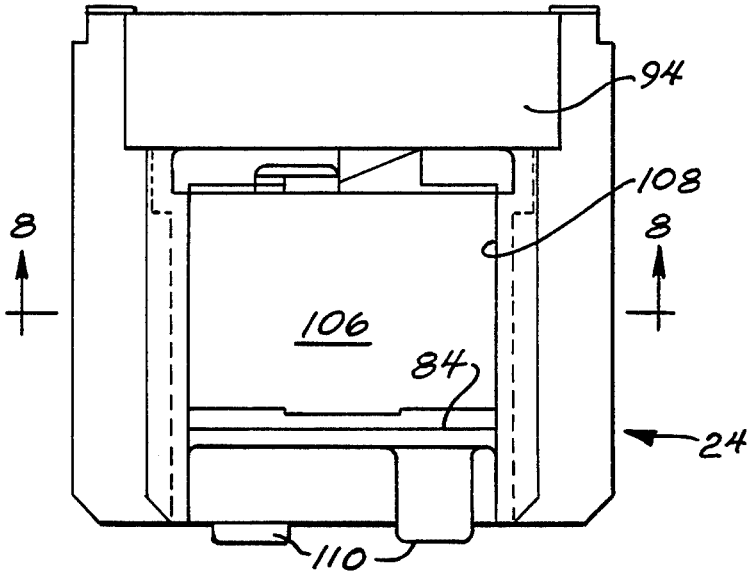
FIG. 6 is a side elevation of a shell utilized in the contactor.
Figure 7:
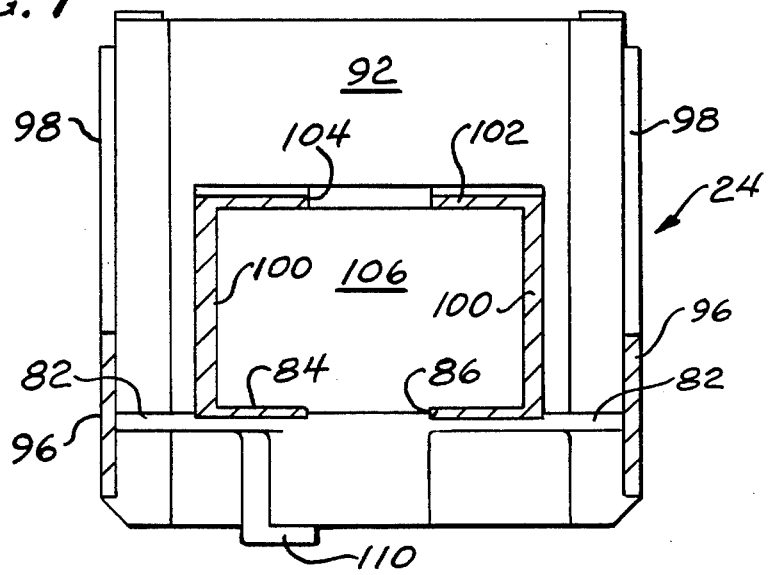
FIG. 7 is a vertical section of the shell.

In addition, locating projections 110 may depend from the bottom wall 84 as seen in FIGS. 6 and 7. The projections 110 are adapted to be received in corresponding locating holes 58 in the base 22 to properly locate the shell 24 thereon.

Features of the bobbin 28 are best seen in FIGS. 2, 3, 4 and 5. The same includes upper and lower flanges 112 and 114 which are planar and are spaced by a reduced size central core 116 so that a peripheral winding receiving groove 118 results. One edge 120 of the upper flange 112 is provided with a pair of terminal receiving recesses 122. As can be seen, the opening of each recess 122 is flared as at 124 so as to facilitate receipt of an end 126 of a metal terminal piece 128 as can be best seen in FIG. 5. Preferably, the end 126 includes a dimple 130 so that the end 126 is received within the recess 122 in a slight interference fit to provide for retention of the terminal piece 128 during assembly.

The edge 120, just below each of the recesses 122, additionally mounts metallic pins 132 which project in parallel away from the edge 120. In a preferred embodiment, the bobbin 28 is a molded part and the pins 132 are molded in place by molding the bobbin about the pins 132.

Figure 3:
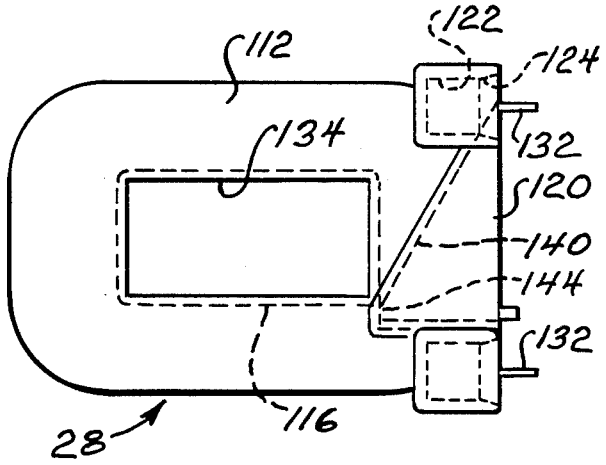
FIG. 3 is a plan view of a bobbin utilized in the contactor.
Figure 4:
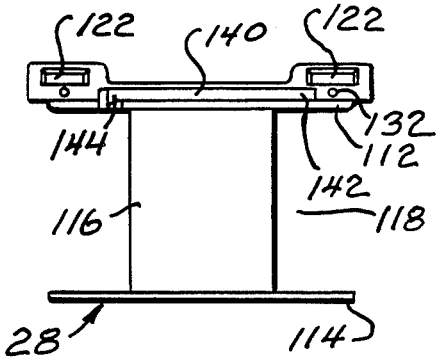
FIG. 4 s an end elevation of the bobbin.

As can be seen in FIGS. 2 and 3, a central opening 134 extends through the core 116. The opening 134 will align with the openings 86 and 104 (FIG. 7) when the bobbin 28 is inserted into the coil receiving chamber 106. Thus, the pole 70 of the core 26 may extend upwardly through the opening 134 in the bobbin 28.

Each bobbin 28 is completed by a ramp-like slot 140 (FIGS. 3 and 4) in the edge 120 of the upper flange 112. The shallow end 142 of the slot 140 terminates adjacent one of the pins 132 while the deep end 144 opens to the winding receiving recess 118 at the bottom thereof.

The ramp-like slot 140 thus provides a means whereby the innermost end of a winding placed in the recess 118 may be guided to the exterior of the bobbin 28 in such a way as to be isolated from more outermost layers of such a winding.

Figure 5:
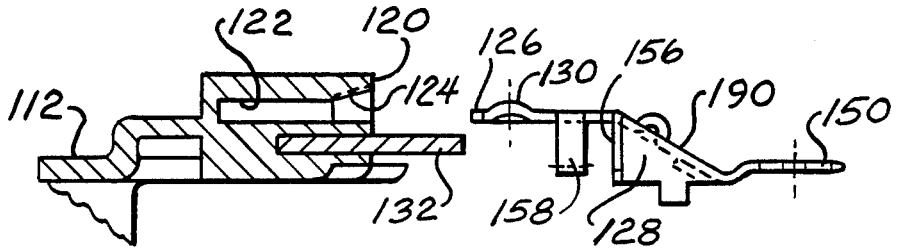
FIG. 5 is an exploded, sectional view of a bobbin and a terminal.

The terminals 28 are configured generally as illustrated in FIGS. 2 and 5 and opposite the mounting ends 126 include ends 150 for receiving a spade terminal or the like. Intermediate the ends 126 and 150, each of the terminal pieces 128 includes a threaded aperture 152 for receipt of a terminal screw 154 (FIG. 1) if desired.

In addition, intermediate the ends 126 and 150, each terminal piece 128 includes horizontally and oppositely directed wings 156 for purposes to be seen.

Intermediate the end 126 and the wings 156, an integral finger 158 is provided. Each finger 158 is generally transverse to the direction of elongation of the basic terminal piece 128 of which it is part and includes a curved base part 160 terminating in a relatively straight end 162. The curved base part 160 has an arcuate extent of about 180° and the radius is sufficiently great that the straight end 162 is spaced substantially below the point of attachment of the finger 156 to the main part of the terminal piece 128 as is apparent from FIGS. 5, 11 and 12. The arrangement is such that the finger 156 will be disposed about, but in substantially spaced relation to, a corresponding pin 132 when the terminal piece end 126 is received the adjacent recess 122. This relationship is best seen in FIGS. 11 and 12.

The bobbin 28 may be wound with electrical wire in a conventional fashion with one end being led to the pin 132 nearest the shallow end 142 of the ramp-like slot 140 by being disposed in the slot 140 and the other end, which will be at the radially outermost layer of the winding, led to the other pin 132. One end 164 of such winding is illustrated in FIGS. 11 and 12 as being wrapped about the corresponding pin 132. After such wrapping has taken place, the terminal piece 128 will have its end 126 disposed in the corresponding recess 122 which will bring the finger 156 into partial surrounding relationship to the pin 132 with the winding end 164 wrapped therearound as illustrated in FIGS. 11 and 12. A simple crimping force applied in the direction of an arrow 166 (FIG. 11) will then bring the terminal piece 128 into electrical contact with the winding end 164. If desired, the crimping operation may include a weld to assure excellent electrical contact.

Figure 8:
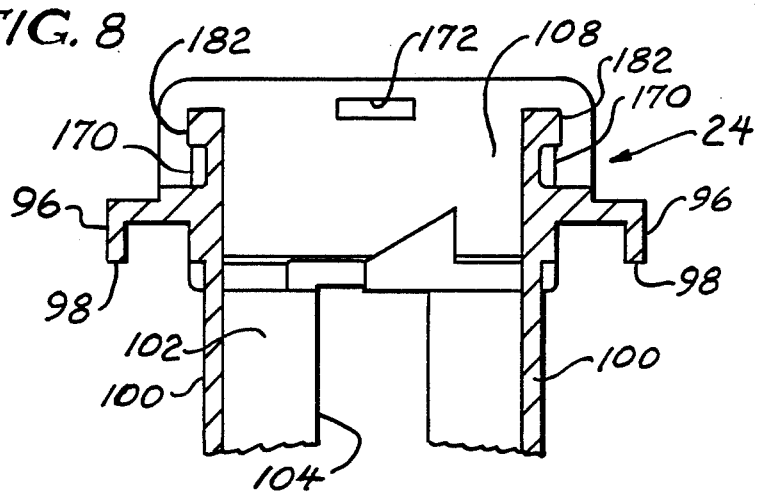
FIG. 8 is a fragmentary, horizontal section taken approximately along the line 8—8 in FIG. 6.

When the bobbin 28 with the terminal pieces 128 assembled thereto in the manner just described is inserted within the coil receiving chamber 106, the flanges 112 and 114 will be in substantial abutment with the interior wall 102 and bottom wall 84 respectively and the terminal pieces themselves will project out of the access opening 108. The shell 24, on opposite sides of the access opening 108 in what might be termed extensions of the interior walls 100 include oppositely opening grooves 170 as best seen in FIG. 8. In addition, the interior wall 102, near its forward edge, includes an opening 172.

A single or unitary closure piece 174 (FIGS. 2, 9 and 10) is employed for the dual purpose of closing the access opening 108 and for rigidifying the terminal pieces 128 within the assembly. On the rear side 176 of the closure piece 174, there are vertically oriented, facing tongues 178 (only one of which is shown) which thus define grooves 180 (again only one of which is shown). The arrangement is such that the tongues 178 may slide within the grooves 170 on the shell 24 while the ends 182 of the interior side wall extension are located in the grooves 180 to provide a mating arrangement whereby the closure 174 is secured to the shell 124 to close the access opening 108. To facilitate initial placement of the closure 170 on the shell 24, the upper edges of the tongues 178 may be beveled as at 184.

The front side 186 of the closure 174 includes a pair of terminal support surfaces 188 that extend angularly from the closure 174 near the upper edge thereof. As can be seen from an inspection of FIG. 5, the terminal piece 128 includes an angled section 190 just forwardly of the wings 156 and this section is adapted to abut and be supported by a corresponding one of the support surfaces 188 on the closure 174.

Figure 9:
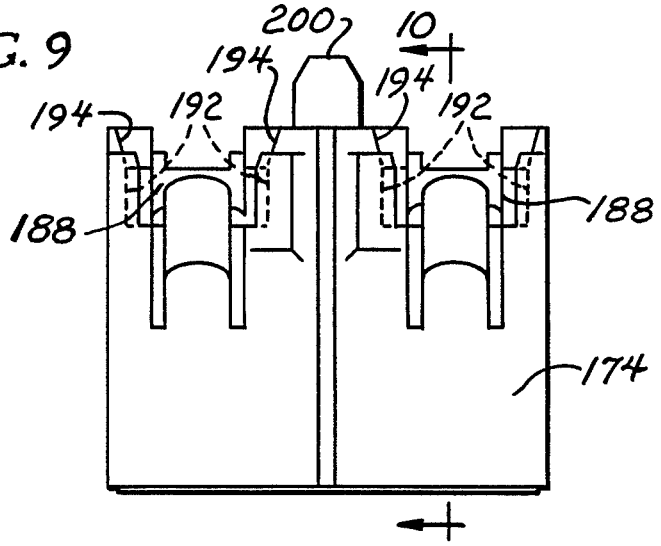
FIG. 9 is side elevation of a closure for assembly to the shell.
Figure 10:
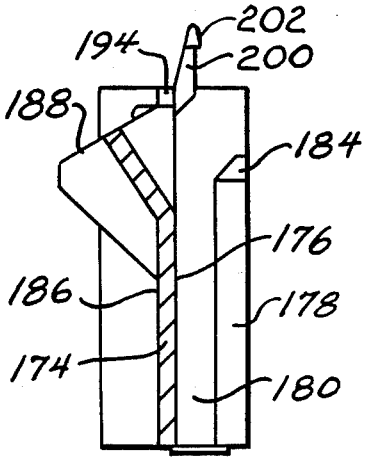
FIG. 10 is vertical section taken approximately along the line 10—10 in FIG. 9.

In addition, and as best seen in FIG. 9, to each side of each of the terminal support surfaces 188 is a wing receiving groove 192. As the closure 174 is slided on the shell 24 with the bobbin 28 within the chamber 106, beveled pilot surfaces 194 extending to the grooves 192 pilot the wings 156 into the grooves 192 wherein they are firmly retained to rigidify the assembly of the terminal pieces 128 to the overall contactor.

At its uppermost end, the closure 174 includes an integral finger 200 terminating in a hook-like tip 202. The finger 200 is adapted to enter the aperture 172 in the upper interior wall 102 and deflect somewhat such that the hooklike end 202 comes to rest in overlying relation to that wall to firmly retain the closure 174 in place.

A number of advantages accrue from the foregoing construction. For one, the unique use of the pins 132 cast into the edge 120 of the bobbin in close adjacency to the terminal receiving recesses 122 readily facilitates connection of the terminal piece 128 to the winding end 164 to simplify manufacture and achieve a cost advantage.

In addition, the unique configuration of the walls defining the coil receiving chamber 106 as well as the bobbin 28 provide complete assurance that there will be excellent electrical isolation of the windings on the bobbin and the poles of the magnetic core 26 or the armature 30. As a consequence, reliability is enhanced.

We claim:

1. In a contactor, the combination of:

a base;

a contactor assembly, including at least one movable contact, mounted on said base;

a magnetic core mounted on said base in proximity to said contactor assembly;

a bobbin mounted on said magnetic core and having spaced flanges defining a peripheral winding receiving recess, at least one of said flanges having terminal receiving recesses in an edge thereof;, metallic pins, one for each terminal receiving recess, each having one end captured in said edge adjacent the corresponding terminal receiving recess and an opposite end projecting away from the corresponding terminal receiving recess;

an electrical winding in said winding receiving recess and having ends extending therefrom and wrapped about a corresponding one of said pins; and a plurality of metallic terminals, one for each terminal receiving recess, and having a mounting end disposed in the corresponding recess and a finger crimped about the corresponding pin and the winding end wrapped thereabout.

2. The contactor of claim 1 wherein one of said flanges having a terminal receiving recess therein further includes a ramp-like slot extending from the terminal receiving recess substantially to the bottom of the winding receiving recess, one of said winding ends passing through said ramp-like slot.

3. The contactor of claim 1 wherein said bobbin is a molded part and said pins are captured by molding the bobbin about said one ends thereof.

4. The contactor of claim 1 further including a shell on said base and having a coil chamber receiving said bobbin, an access opening to said chamber in said shell through which said bobbin may be introduced, a closure for said access opening, and means on said closure for engaging said terminals and mounting the same to at least one of said closure and said shell.

5. The contactor of claim 4 wherein said closure and said shell include mating tracks so that said shell may slideably receive said closure about said access opening.

6. The contactor of claim 4 wherein walls on said shell define said chamber generally in the shape of a rectangular solid and said access opening is located at one end wall thereof; said bobbin having a central opening separated from said winding receiving recess by a core and by said flanges for receiving a pole of said magnetic core, opposed walls of said shell adjacent said access opening also having openings for receipt of said pole of magnetic core and being aligned with said central opening, said flanges being in substantial abutment with corresponding ones of said opposed walls.

7. The contactor of claim 4 wherein said closure is a single closure piece.

8. In a contactor, the combination of:

a base;

a contactor assembly, including at least one movable contact, mounted on said base;

a magnetic core having at least one pole and mounted on said base in proximity to said contactor assembly;

a bobbin having a central opening and disposed on said magnetic core with said pole extending through said central opening and having spaced flanges defining a peripheral winding receiving recess;

an electrical winding in said winding receiving recess and having ends extending therefrom;

a plurality of metallic terminals, one for each winding end and mounted on said bobbin; and a shell on said base including walls defining a coil chamber in the shape of a rectangular solid, an access opening to said chamber through one of said walls and sized to snugly receive said bobbin, opposed walls of said shell adjacent said one wall having aligned openings receiving said pole, said bobbin being located in said chamber with said central opening aligned with said aligned openings and receiving said pole.

9. The contactor of claim 8 wherein said flanges are generally planar and are in substantial abutment with corresponding ones of said opposed walls.

10. The contactor of claim 9 wherein said terminals extend from said chamber through said access opening and further including a closure mounted on said shell for closing said opening and for engaging and supporting said terminals.

11. in a contactor, the combination of:

a base;

a contactor assembly, including at least one movable contact, mounted on said base;

a magnetic core including at least one pole mounted on said base in proximity to said contactor assembly;

a bobbin mounted on said pole and having spaced flanges defining a peripheral winding receiving recess, said flanges having spaced receiving recesses in an edge thereof;

metallic pins, one for each terminal receiving recess each having one end captured in said edge adjacent the corresponding terminal receiving recess and an opposite end projecting away from the corresponding terminal receiving recess in generally parallel relation;

an electrical winding in said winding receiving recess and having ends extending therefrom and wrapped about a corresponding one of said pins;

a plurality of metallic terminals, one for each terminal receiving recess, and having a mounting end disposed in the corresponding recess and a finger crimped about the corresponding pin and the winding end wrapped thereabout;

a shell on said base and having a bobbin receiving chamber, said chamber being sized to snugly receive said bobbin and having opposed openings aligned with and receiving said pole and an intermediate access opening through which said bobbin may be introduced into said chamber such that said terminals extend from said chamber through said access opening;

a closure receivable by said shell for closing said access opening; and means effective upon closing said access opening by said closure for securing said terminals in their respective recess.

* * * * *